US009206982B2

(12) United States Patent
Naumann

(10) Patent No.: US 9,206,982 B2
(45) Date of Patent: Dec. 8, 2015

(54) GAS VALVE UNIT COMPRISING A LIFT DEFLECTION SYSTEM

(75) Inventor: Jörn Naumann, Durbach (DE)

(73) Assignee: BSH Hausgeraete GmbH, Munich (DE)

( * ) Notice: Subject to any disclaimer, the term of this patent is extended or adjusted under 35 U.S.C. 154(b) by 277 days.

(21) Appl. No.: 13/989,824

(22) PCT Filed: Dec. 7, 2011

(86) PCT No.: PCT/EP2011/072056

§ 371 (c)(1),
(2), (4) Date: May 28, 2013

(87) PCT Pub. No.: WO2012/080054

PCT Pub. Date: Jun. 21, 2012

(65) Prior Publication Data

US 2013/0248745 A1 Sep. 26, 2013

(30) Foreign Application Priority Data

Dec. 14, 2010 (EP) ..... 10290660

(51) Int. Cl.
*F23N 1/00* (2006.01)
*F23K 5/00* (2006.01)

(52) U.S. Cl.
CPC ..... *F23N 1/007* (2013.01); *F23K 5/007* (2013.01); *F23N 2035/16* (2013.01); *F23N 2035/18* (2013.01); *F23N 2035/22* (2013.01); *F23N 2035/24* (2013.01); *F23N 2037/10* (2013.01)

(58) Field of Classification Search
CPC . F23N 1/007; F23N 2037/10; F23N 2035/16; F23N 2035/24; F23N 2035/22; F23N 2035/18; F23K 5/007
USPC ..... 251/251, 262–263, 337
See application file for complete search history.

(56) References Cited

U.S. PATENT DOCUMENTS 5,295,476 A * 3/1994 Herbert ..... 126/39 G
5,979,484 A * 11/1999 Grando et al. ..... 137/66

FOREIGN PATENT DOCUMENTS

DE 102008027546 A1 12/2009
EP 0486796 A1 * 5/1992
EP 1058059 A2 12/2000
EP 1672279 A1 6/2006

(Continued)

OTHER PUBLICATIONS

Translation of Schwarz DE 102008027546.*

(Continued)

*Primary Examiner* — John Bastianelli
(74) *Attorney, Agent, or Firm* — James E. Howard; Andre Pallapies

(57) ABSTRACT

A gas valve unit for setting a gas volume flow supplied to a gas burner of a gas appliance includes a valve housing, and an actuation pin having an operating segment which projects from the valve housing. Received in the valve housing is a shutoff valve which is configured for actuation by axially displacing the actuation pin, and at least two on-off valves which are configured for actuation by rotating the actuation pin. The shutoff valve has a movable shutoff element. A deflection device converts an axial movement of the actuation pin into an axial movement of the shutoff element of the shutoff valve essentially at a right angle thereto.

11 Claims, 6 Drawing Sheets

(56) References Cited

FOREIGN PATENT DOCUMENTS

| | | |
|---|---|---|
| GB | 2196732 A | 5/1988 |
| WO | 9012255 | 10/1990 |

OTHER PUBLICATIONS

International Search Report PCT/EP2011/072056 dated Aug. 23, 2013.

* cited by examiner

GAS VALVE UNIT COMPRISING A LIFT DEFLECTION SYSTEM

BACKGROUND OF THE INVENTION

The invention relates to a gas valve unit for setting a gas volume flow supplied to a gas burner of a gas appliance, in particular a gas cooker, the gas valve unit having a valve housing and an actuation pin, an operating segment of which projects from the valve housing and a shutoff valve being configured in the valve housing.

Gas valves of such design are frequently referred to as safe gas valves. The gas valve unit has a variable cross section, which can be set by way of the actuation pin. The opening cross section here can be set infinitely. The size of the gas volume flow flowing through the gas valve unit and therefore also the flame size at the gas burner are a direct function of the opening cross section. Generally with generic gas valve units the opening cross section can be set to zero, in other words the gas valve unit can be closed completely.

The gas valve unit also has a shutoff valve that can be actuated independently of the setting of the opening cross section. The shutoff valve generally has an open switching position and a closed switching position but no intermediate positions. When the shutoff valve is closed, the gas flow through the gas valve unit is stopped completely. In contrast the opened shutoff valve has no influence on the opening cross section of the gas valve unit. The shutoff valve serves on the one hand to ensure complete closure of the gas valve unit in a redundant manner. On the other hand it is possible to actuate the shutoff valve automatically for example as a function of the signal from a flame sensor.

Known gas valve units of the type mentioned in the introduction are generally embodied as plug valves. The opening cross section here is set as a function of the rotation position of a plug that can be rotated in a valve seat. The actuation pin is disposed coaxially to the plug and connected thereto. The opening cross section of the gas valve unit is set by rotating the actuation pin. The shutoff valve can be opened by pushing the same actuation pun.

Gas valve units of such design frequently have an unfavorable switching response. In particular the opening cross section can frequently only be set in an imprecise and non-reproducible manner.

BRIEF SUMMARY OF THE INVENTION

The object of the present invention is to provide a generic gas valve unit having an improved switching response.

According to the invention this object is achieved in that at least two on-off valves are configured in the valve housing, it being possible to actuate the on-off valves by rotating the actuation pin and it being possible to actuate the shutoff valve by axially displacing the actuation pin. The on-off valves serve to set the opening cross section of the gas valve unit and thus the size of the gas volume flow flowing through the gas valve unit. This can be done for example by opening the on-off valves one after the other and closing them again. The on-off valves are actuated by rotating the actuation pin. The gas valve unit also has an additional shutoff valve, which when closed completely stops the gas flow through the valve unit. When open the shutoff valve has an opening cross section of such size that the size of the gas volume flow is set exclusively by opening and closing the on-off valves. The shutoff valve is actuated by axial movement of the actuation pin. Both the on-off valves and the shutoff valve can thus be actuated by way of the same actuation pin.

At least two throttle points, each having at least one throttle opening, are particularly advantageously configured in the valve housing. Gas can flow through said throttle points as a function of the switching position of the on-off valves. Just one throttle point is preferably assigned to each on-off valve. When an on-off valve is opened, gas can flow through said throttle point but when an on-off valve is closed, gas cannot flow directly from the gas inlet through the throttle point assigned to said on-off valve but by way of a diversion through other throttle points.

The shutoff valve is preferably disposed in the region of a gas inlet of the gas valve unit. When the shutoff valve is closed, there is therefore no gas present at any of the on-off valves or at any throttle point. If there are leak points in the region of the on-off valves or the throttle points, an outflow of gas from said leak points is reliably prevented when the shutoff valve is closed.

The shutoff valve preferably has a movable shutoff element. The shutoff element can be formed for example by an axially movable valve plate, which pushes onto an annular valve seat in the closed state.

The movable shutoff element of the shutoff valve is pretensioned in the closing direction, in particular by means of spring force. This means that the shutoff valve is always closed when the gas appliance is out of operation.

The movable shutoff element of the shutoff valve can be moved into an open position counter to the pretensioning by pushing the actuation pin. The pushing movement of the actuation pin is transferred directly or indirectly to the shutoff element. In the open position the shutoff element is raised from the valve seat of the shutoff valve, thereby releasing the gas path from the gas inlet of the valve housing in the direction of the on-off valves.

The movable shutoff element of the shutoff valve can also be held in the open position counter to the spring force by the force of a magnetic coil. The shutoff valve has a magnetic coil, with which a force acting in the opening direction can also be applied to the shutoff element. Voltage can be applied to the magnetic coil here for example by a thermocouple or an electronic controller. The magnetic coil is designed so that when it is already in the open position the shutoff element can be held in this position by means of the force of the magnetic coil. In contrast it is not possible to move the shutoff element from a closed position into the open position by means of the force of the magnetic coil. The magnetic coil is coupled to a flame sensor in the region of a gas burner in such a manner that the shutoff valve is held open when a gas flame burns at the gas burner. When the gas flame has been extinguished, the power supply to the magnetic coil is interrupted and the shutoff valve closes automatically by means of spring force.

According to one expedient embodiment of the invention a deflection apparatus is provided, which converts an axial movement of the actuation pin to an axial movement of the shutoff element of the shutoff valve essentially at right angles thereto. The movement direction of the shutoff element here is perpendicular to the axial actuation direction of the actuation pin. Such a gas valve unit structure is chosen to minimize the dimensions of the housing of the gas valve unit in the axial direction of the actuation pin.

The deflection apparatus has a first slide element, which is disposed on the actuation pin in the region of the end of the actuation pin opposite the operating segment. The first slide element is moved with the actuation pin when the actuation pin is moved axially. The first slide element and the actuation pin can be embodied for example as a single piece.

The first slide element is preferably embodied as a first conical element so that a tip of the first conical element points away from the operating segment of the actuation pin. When the actuation pin is pushed, the first conical element moves in the direction of its tip. When the actuation pin is rotated, the spatial location of the first conical element does not change however, as it is rotated about its axis of symmetry.

The deflection apparatus preferably has a second slide element, which is in contact with the first slide element at least when the actuation pin is pushed. In this process the second slide element slides down along the first slide element.

The second slide element is preferably configured as a second conical element, the center axis of which is disposed essentially perpendicular to the actuation pin and the tip of which points in the direction of the first slide element. The configuration of the second slide element as a second conical element has the advantage that the rotation position of the second conical element in relation to its axis of symmetry has no impact on the mode of operation of the deflection apparatus.

The first slide element and the second slide element are configured and disposed so that an axial displacement of the actuation pin as a result of pushing on the operating segment is converted to an axial displacement of the second slide element in the direction away from the actuation pin.

The second slide element is also actively connected to the shutoff element of the shutoff valve so that an axial movement of the second slide element in the direction away from the actuation pin is transferred to the shutoff element. When the actuation pin is pushed, the shutoff element of the shutoff valve is therefore raised from its valve seat, thereby opening the shutoff valve.

Also provided in the gas valve unit is an actuation apparatus for the on-off valves, which is coupled to the actuation pin by means of a coupling apparatus at an end of the actuation pin within the valve housing. The actuation apparatus for example comprises a permanent magnet, which can be moved relative to the on-off valves. A rotation movement of the actuation pin is transferred to the actuation apparatus for the on-off valves by means of the coupling apparatus.

The coupling apparatus here is embodied so that the actuation apparatus is coupled to the actuation pin with torsional rigidity.

The coupling apparatus is also embodied so that an axial displacement of the actuation pin is not transferred to the actuation apparatus.

To this end the coupling apparatus has a slot-type recess on an end face of the end of the actuation pin opposite the operating segment.

The coupling apparatus further comprises a flat carrier, which engages in the slot-type recess. The flat carrier engaging in the slot-type recess allows transmission of a torque from the actuation pin to the actuation apparatus of the on-off valves. Axial movement of the actuation pin is compensated for in that the flat carrier is inserted to a greater or lesser degree into the slot-type recess.

The recess is particularly advantageously disposed in a base of a third conical element, which is configured on the actuation pin in the region of the end of the actuation pin opposite the operating segment, so that a tip of the third conical element points in the direction of the operating segment of the actuation pin and is connected to a tip of the first conical element. The configuration of the end of the actuation pin as a conical element has the advantage that the spatial extension of a conical element does not change when the actuation pin is rotated. There is therefore no risk of unintended movement of the second slide element because it accidentally comes into contact with the third conical element.

BRIEF DESCRIPTION OF THE DRAWINGS

Further advantages and details of the invention are described in more detail with reference to the exemplary embodiment illustrated in the schematic figures, in which.

DETAILED DESCRIPTION OF EXEMPLARY EMBODIMENTS OF THE PRESENT INVENTION

Figure 1:
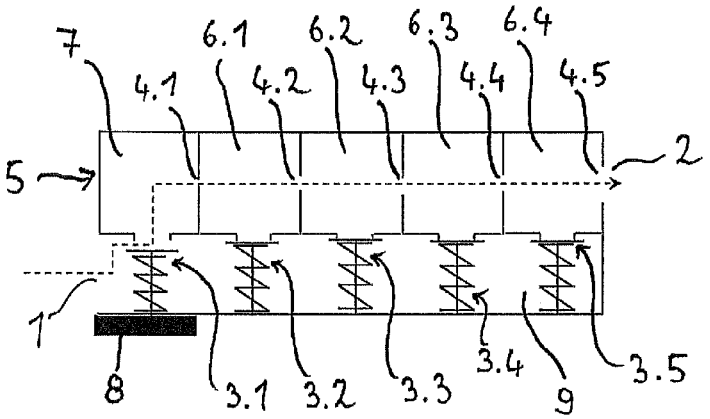
FIG. 1 shows a schematic switching arrangement of the on-off valves and the throttle points with a first on-off valve opened.
Figure 2:
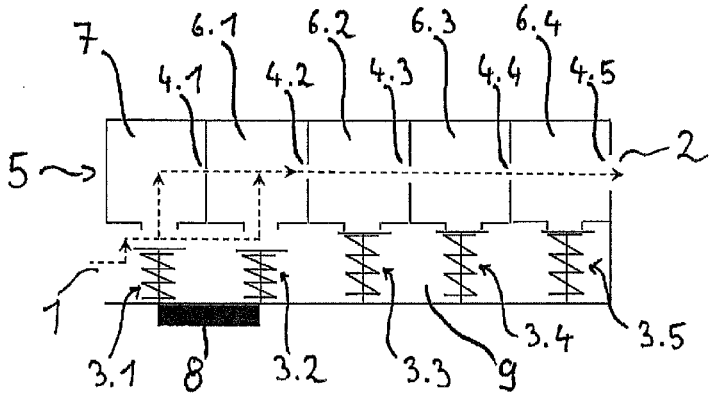
FIG. 2 shows the schematic switching arrangement with two on-off valves opened.
Figure 3:
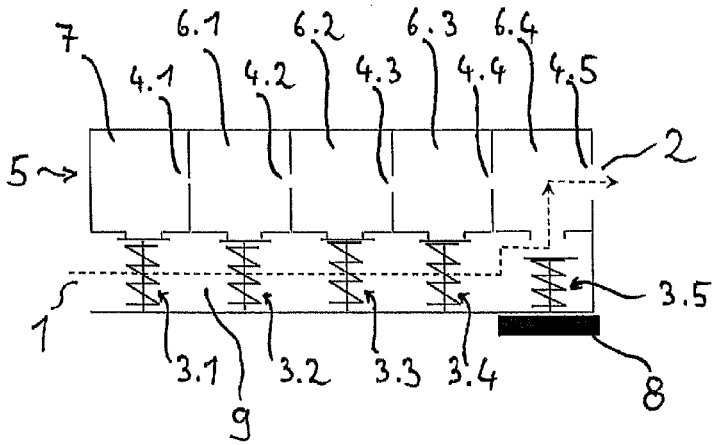
FIG. 3 shows the schematic switching arrangement with the last on-off valve opened.

FIGS. 1 to 3 show the switching arrangement of the on-off valves 3 (3.1 to 3.5) and the throttle points 4 (4.1 to 4.5) of the gas valve unit. The inventive shutoff valve is however not shown here.

A gas inlet 1 is shown, by way of which the gas valve unit is connected for example to a main gas line of a gas cooker. The gas provided for combustion is present at the gas inlet 1 with a constant pressure of for example 20 millibars or 50 millibars. Connected to a gas outlet 2 of the gas valve unit is a gas line, which leads for example to a gas burner of the gas cooker. The gas inlet 1 is connected by way of a gas inlet chamber 9 of the gas valve unit to the inlet side of the, in the present exemplary embodiment, five on-off valves 3 (3.1 to 3.5). Opening the on-off valves 3 connects the gas inlet 1 in each instance to a specified segment of a throttle section 5, into which the gas flows by way of the opened on-off valve 3. The throttle section 5 comprises an inlet segment 7, into which the first on-off valve 3.1 opens. The further on-off valves 3.2 to 3.5 open respectively into a connecting segment 6 (6.1 to 6.4) of the throttle section 5. The transition between the inlet segment 7 and the first connecting segment 6.1 and the transitions between two adjacent connecting segments 6.1 to 6.4 are formed respectively by a throttle point 4 (4.1 to 4.5). The last throttle point 4.5 connects the last connecting segment 6.4 to the gas outlet 2. The throttle points 4.1 to 4.5 have an opening cross section that increases along the row. The throughflow cross section of the last throttle point 4.5 can be selected to be of such size that the last throttle point 4.5 has practically no throttle function.

The on-off valves 3 are actuated by means of a permanent magnet 8, which can be displaced along the row of on-off valves 3. The force for opening the respective on-off valve 3 is formed here directly by the magnetic force of the permanent magnet 8. This magnetic force opens the respective on-off valve 3 counter to a spring force.

In the switching position according to FIG. 1 only the first on-off valve 3.1 is opened. Gas flows through this on-off valve 3.1 from the gas inlet chamber 9 into the inlet segment 7, passing through all the throttle points 4 and all the connecting segments 6 from there on the path to the gas outlet 2. The quantity of gas flowing through the valve unit predetermines the minimum output of the gas burner connected to the gas valve unit.

FIG. 2 shows the schematic switching arrangement, in which the permanent magnet 8 is displaced to the right in the drawing so that both the first on-off valve 3.1 and the second on-off valve 3.2 are opened.

The gas flows through the opened second on-off valve 3.2 from the gas inlet chamber 9 directly into the first connecting segment 6.1 and from there by way of the throttle points 4.2 to 4.5 to the gas outlet 2. The gas flowing to the gas outlet 2 bypasses the first throttle point 4.1 due to the opened on-off valve 3.2. The gas volume flow in the switching position according to FIG. 2 is therefore greater than the gas volume flow in the switching position according to FIG. 1. The gas flows to the first connecting segment 6.1 almost exclusively by way of the second on-off valve 3.2. The open on-off valves 3.1 and 3.2 mean the same pressure level prevails in the inlet segment 7 as in the first connecting segment 6.1. Therefore virtually no gas flows out of the inlet segment 7 by way of the first throttle point 4.1 into the first connecting segment 6.1. The gas volume flow flowing overall through the gas valve unit does not therefore change to any degree, when the permanent magnet 8 is moved further to the right in the drawing, thereby closing the first on-off valve 3.1 while the second on-off valve 3.2 remains open.

Moving the permanent magnet 8 to the right in the drawing causes the on-off valves 3.3 to 3.5 to be successively opened, thereby increasing the gas volume flow through the gas valve unit in steps.

FIG. 3 shows the schematic switching arrangement of the gas valve unit in the maximum open position. Here the permanent magnet 8 is in its end position on the right side in the drawing. When the permanent magnet 8 is in this position, the last on-off valve 3.5 is opened. Gas flows directly out of the gas inlet chamber 9 into the last connecting segment 6.4, only passing through the last throttle point 4.5 on the path to the gas outlet 2. This last throttle point 4.5 can have a throughflow cross section of such size that there is practically no throttling of the gas flow and the gas can flow through the gas valve unit practically unthrottled.

Figure 4:
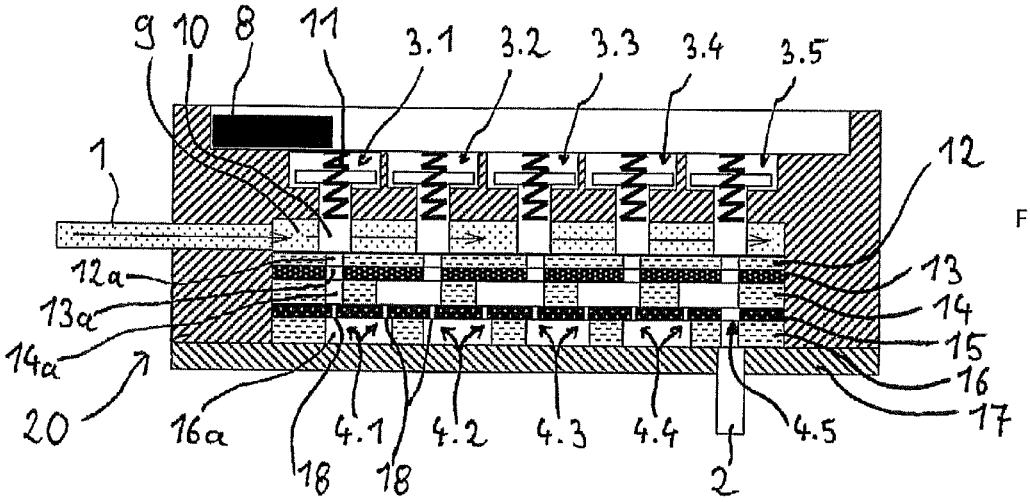
FIG. 4 shows a schematic structure of a gas valve arrangement with on-off valves closed.

FIG. 4 shows a schematic diagram of a structure of a gas valve unit with a switching arrangement according to FIGS. 1 to 3. The inventive shutoff valve is not shown again here.

FIG. 4 shows a valve body 20, in which the gas inlet 1 of the gas valve unit is embodied. Present in the interior of the valve body 20 is a gas inlet chamber 9 connected to the gas inlet 1. Shutoff bodies 10 of the on-off valves 3 are passed through the valve body 20 in such a manner that they can move up and down in the drawing. Each shutoff body 10 is pretensioned downward in the drawing by means of a spring 11. The force of the permanent magnet 8 allows each shutoff body 10 to be moved upward in the drawing counter to the force of the spring 11. The springs 11 push the shutoff bodies onto a valve sealing plate 12, so that the shutoff bodies 10 close off openings 12*a* present in the valve sealing plate 12 in a gas-tight manner. Disposed below the valve sealing plate 12 is a pressure plate 13 with openings 13*a* which correspond to the openings 12*a* in the valve sealing plate 12. The openings 13*a* in the pressure plate 13 open in openings 14*a* into a first gas distribution plate 14. Present below the first gas distribution plate 14 in the drawing is a throttle plate 15 with a plurality of throttle openings 18. Each of the throttle points 4.1 to 4.4 is formed by two throttle openings 18. The two throttle openings 18 associated with a throttle point 4.1 to 4.4 are connected respectively to one another by means of the openings 16*a* in a second gas distribution plate 16. The openings 14*a* in the first gas distribution plate in contrast connect the neighboring throttle openings 18 of two adjacent throttle points 4.1 to 4.5. The last throttle point 4.5 consists of just one throttle opening 18, which opens by way of a corresponding opening 16*a* in the second gas distribution plate 16 into the gas outlet 2 of the gas valve unit.

In the switching position according to FIG. 4 the permanent magnet 8 is in an end position, in which all the on-off valves 3 are closed. The gas valve unit closed as a whole. The gas volume flow is equal to zero. From this switching position the permanent magnet 8 is moved to the right in the drawing, thereby opening each of the on-off valves 3 disposed below the permanent magnet 8.

Figure 5:
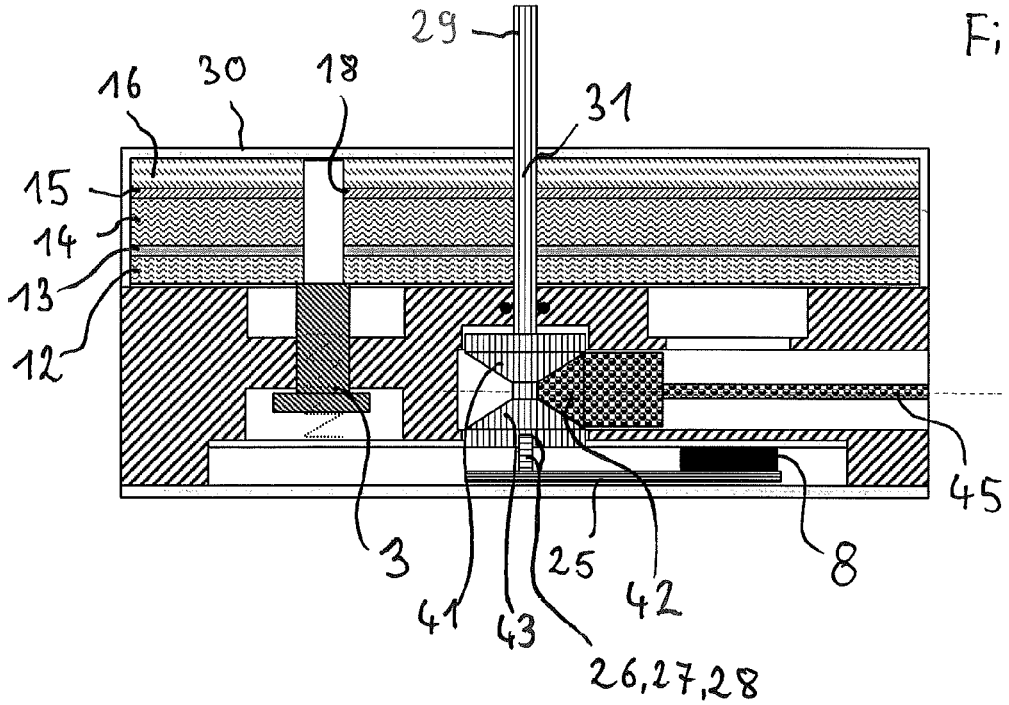
FIG. 5 shows the schematic structure of the inventive gas valve unit in the closed state.

FIG. 5 shows the schematic structure of the inventive gas valve arrangement. It shows the essentially rotationally symmetrical valve housing 20 with a centrally disposed actuation pin 31. The, by way of example, five on-off valves 3 are disposed along an arc around the actuation pin 31. At the upper end of the actuation pin 31 is its operating segment 29, on which for example a knob can be positioned. Disposed at the lower end of the actuation pin 31 is an actuation apparatus 25, at the outer end of which the permanent magnet 8 is disposed. When the actuation pin 31 is rotated, the permanent magnet 8 moves along an arc past the on-off valves 3. The on-off valves 3 which are directly above the permanent magnet 8 are opened in each instance by the magnetic force of the permanent magnet 8. A knob that can be gripped directly by the operator for example can be positioned at the top of the actuation pin 31.

A cover 30 is configured on the upper face of the valve body, in which, from bottom to top, the valve sealing plate 12, the pressure plate 13, the first gas distribution plate 14, the throttle plate 15 and the second gas distribution plate 16 are disposed. The plates 12 to 16 can be accessed by removing the cover 30. Access to the plates 12 to 16 is from above, in other words from the same side from which the actuation pin 31 projects from the valve housing 20.

The throttle plate 15 in particular can be replaced to adapt the gas valve unit for a different type of gas. Present in the throttle plate 15 are the throttle openings 18, which largely determine the size of the gas volume flow. When the cover is removed upward, all the plates 12 to 16 are present in the cover 30.

Also shown is the arrangement for actuating the shutoff valve 40 (not shown in this figure). It comprises a first slide element 41, which is fastened to the actuation pin 31. The first slide element 41 is in contact with a second slide element 42, which is coupled by way of a connecting element 45 to a valve body of the shutoff valve. Both slide elements 41, 42 are formed by conical bodies. A third conical body 43 serves as part of a coupling apparatus 26, which transfers a rotational movement of the actuation pin 31 to the actuation apparatus 25. The coupling apparatus 26 consists essentially of a carrier 27, which engages in a slot-type recess 28.

In the position illustrated in FIG. 5 the gas valve unit is in the completely closed position. The rotation position of the actuation pin 31 is selected so that the permanent magnet 8 is not below an on-off valve 3 and therefore all the on-off valves 3 are closed. The actuation pin 31 is also not pushed in axially. The second slide element 42 is in a left stop position. The conical body shape of the first slide element 41 means that an exclusively rotational movement of the actuation pin 31 and therefore of the first slide element 41 has no influence on the position of the second slide element 42. The lower end of the actuation pin 31 is also formed by a (third) conical body 43 for the same reason.

In the switching position according to FIG. 5 there is no gas present in the valve housing 20 of the gas valve unit due to the closed shutoff valve 40.

If the switching pin 31 is now pressed in downward in an axial direction, the shutoff valve 40 opens and the valve housing 20 fills with gas.

Figure 6:
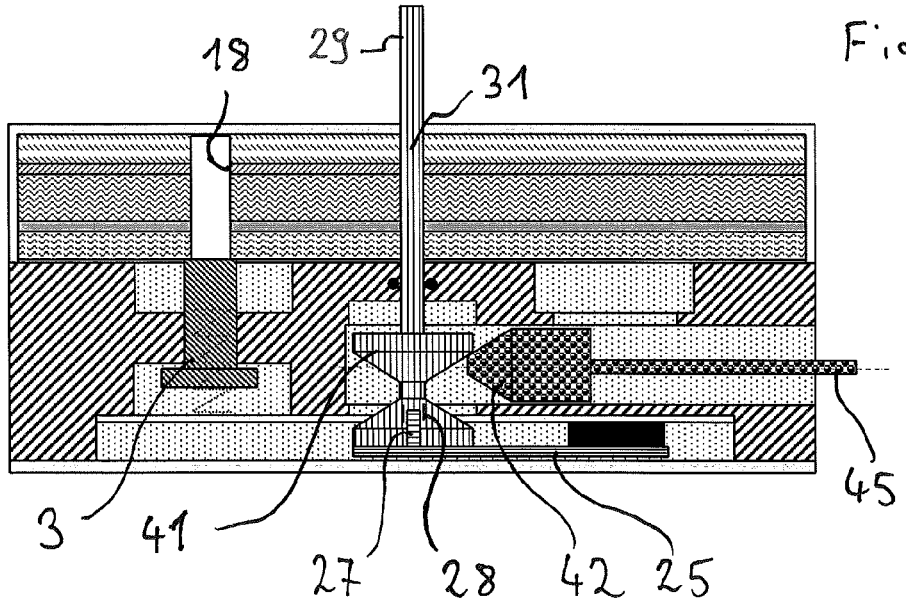
FIG. 6 shows the gas valve unit with the shutoff valve opened.

This state of the gas valve unit is illustrated in FIG. 6. The first slide element 41 here has pushed the second slide element 42 with the connecting element 45 to the right in the drawing. The connecting element 45 acts directly on the shutoff element 44 of the shutoff valve 40 (see FIG. 10) so this is opened. The lower region of the gas valve unit in the drawing is therefore filled with gas (see dotted areas). The on-off valves 3 in contrast remain closed, so the throughflow cross section of the gas valve unit continues to be zero.

FIG. 6 also shows the configuration of the coupling apparatus 26 with the flat carrier 27, which is inserted into the slot-type recess 28 in the third conical body 43. Axial movement of the actuation pin 31 can be compensated for by this combination of carrier 27 and recess 28, so such a movement is not transferred to the actuation apparatus 25 of the on-off valves 3.

Figure 7:
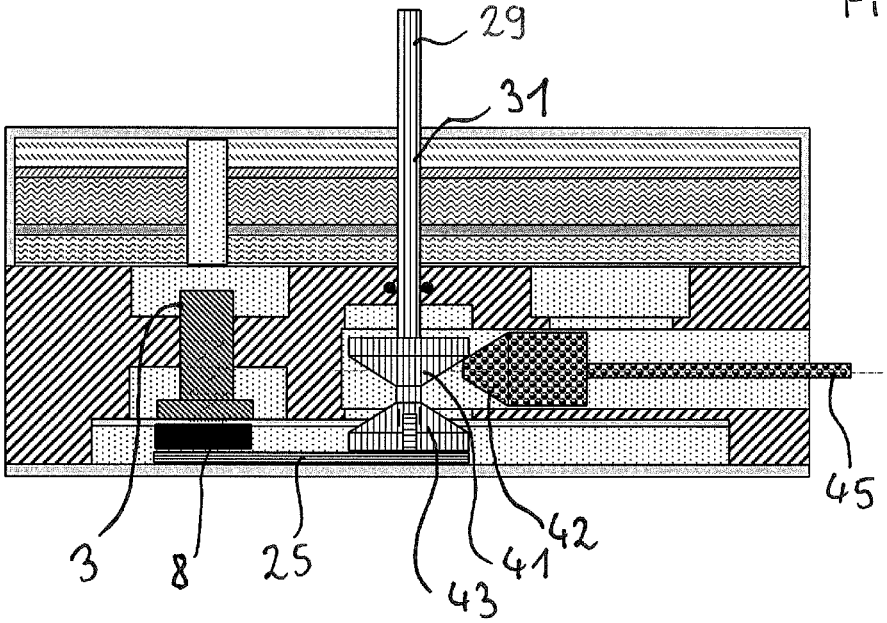
FIG. 7 shows the gas valve unit with the shutoff valve opened and the on-off valve opened.

FIG. 7 shows a further operating position of the gas valve unit, in which the shutoff valve 40 is opened by pushing in the actuation pin 31 and one of the on-off valves 3 is also opened by means of the permanent magnet 8. Gas now also flows through this opened on-off valve 3 into the region above the on-off valve in the direction of the gas outlet 2. As a result the shutoff valve 40 is held mechanically in the open position by way of the first slide element 41, the second slide element 42 and the connecting element 45.

Figure 8:
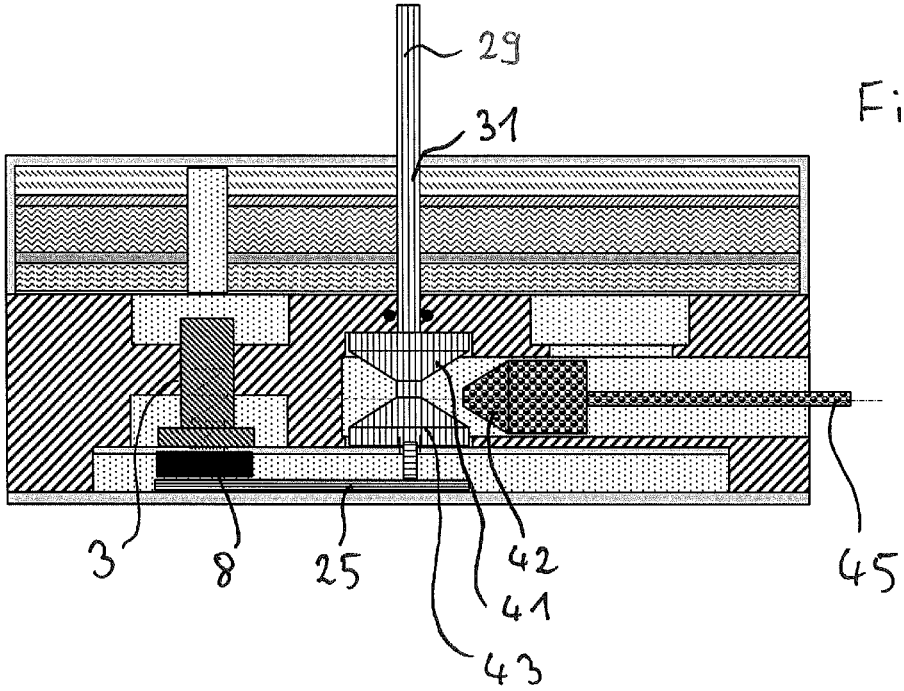
FIG. 8 shows the opened gas valve unit when the actuation pin has not been pushed.

In contrast FIG. 8 shows an operating position of the gas valve unit, in which the shutoff element 44 of the shutoff valve 40 is held in the open position by means of the force of an electromagnet (not shown in the present figure). The actuation pin 32 here is not pushed in, so the first slide element 41 does not apply force to the second slide element 42. The gas valve unit is in this position during ongoing operation, when a flame burns at the gas burner connected to the gas valve unit.

The nature of the actuation of the shutoff valve 40 is described in more detail again with reference to FIGS. 9, 10 and 11. These all show the first slide element 41, the second slide element 42, a connecting element 45 formed by a spring, the shutoff element 44 and a magnetic unit 50. The closed rest position of the shutoff valve 40 is ensured by the spring 51 acting on the shutoff body 10.

Figure 9:
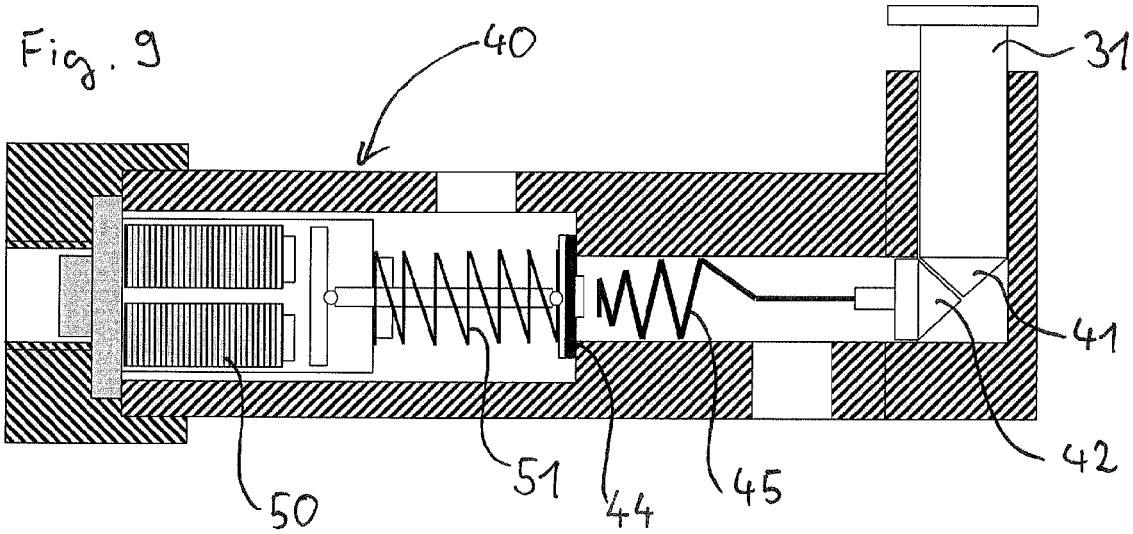
FIG. 9 shows the shutoff valve in the closed state.

In the illustration according to FIG. 9 the actuation pin is not pushed in. The shutoff valve 40 is closed by the force of the spring 51. The connecting element 45 is at a distance from the shutoff body 10.

Figure 10:
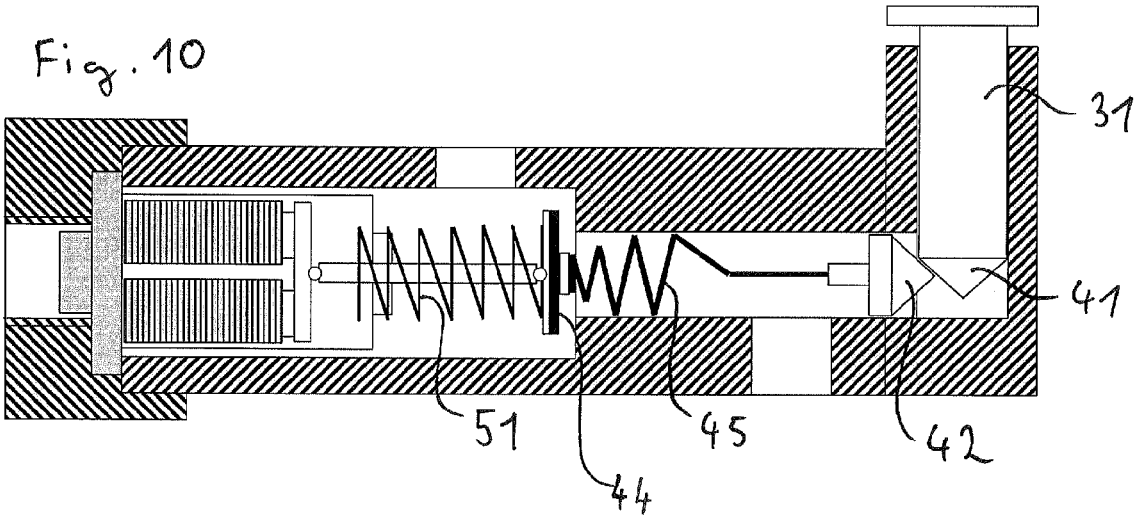
FIG. 10 shows the shutoff valve opened.

In the switching position according to FIG. 10 the actuation pin 31 is pushed in, so that the second slide element 42 with the connecting element 45 is displaced to the left in the drawing and the shutoff element 44 rises from its valve seat counter to the force of the spring 51. This allows gas to flow through the shutoff valve 40.

Figure 11:
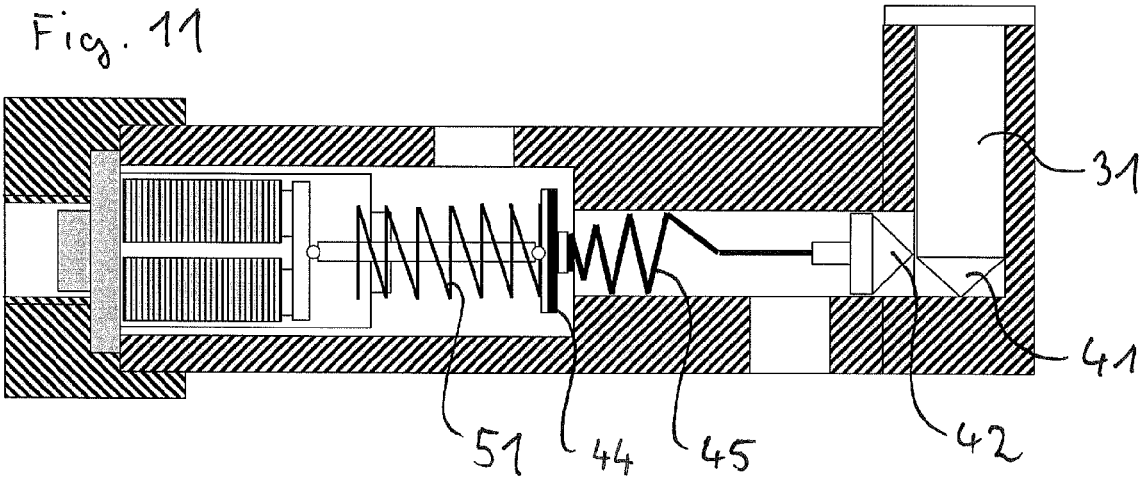
FIG. 11 shows the opened shutoff valve with the actuation pin pushed some distance.

In the illustration according to FIG. 11 the actuation pin 31 is also pushed in but further than in the position according to FIG. 10. The second slide element 42 is therefore also displaced further to the left in the drawing than in FIG. 10. So that this further movement of the second slide element 42 is not transferred to the shutoff element 44 of the shutoff valve 40, the connecting element 45 is embodied as a spring. The spring forming the connecting element 45 is however much more rigid than the spring 51 of the shutoff valve 40. The configuration of the connecting element 45 as a spring serves in particular to prevent damage to the shutoff valve 40, when the actuation pin 31 is pushed with excessive force.

Figure 12:
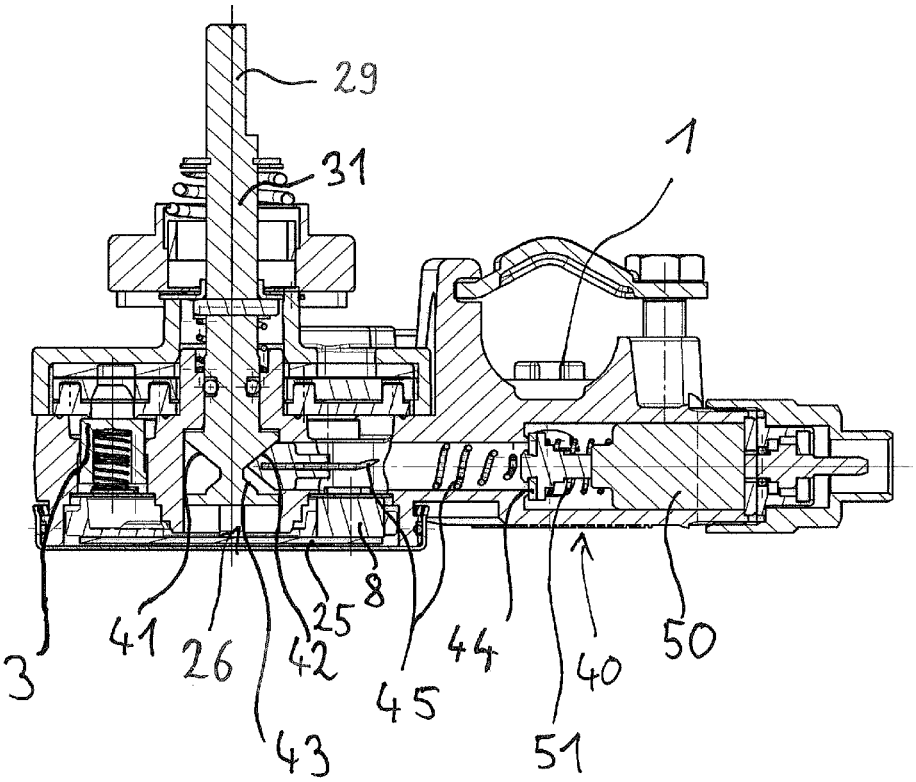
FIG. 12 shows a sectional view of the gas valve unit.

FIG. 12 shows an inventive gas valve unit in cross section. It shows the gas inlet 1, which opens directly into the shutoff valve 40. In particular the shutoff body 10, the spring 51 and the magnetic unit 50 of the shutoff valve 40 are clearly shown.

The connecting element 45 configured as a spring is suitable for transferring a pressure force of the second slide element 42 to the shutoff body 10. In this process the second slide element 42 slides down along the first slide element 41, which is configured from the actuation pin 31.

Present below the first slide element 41 is the third conical element 43 with the coupling apparatus 26, which transfers a rotational movement of the actuation pin 31 to the permanent magnet 8. The magnetic force of the permanent magnet 8 opens the on-off valve 3 directly above it in each instance.

The invention claimed is:

1. A gas valve unit for setting a gas volume flow supplied to a gas burner of a gas appliance, said gas valve unit comprising:

a valve housing;

an actuation pin having an operating segment which projects from the valve housing and an end located within the valve housing;

a shutoff valve received in the valve housing and configured for actuation by axially displacing the actuation pin;

at least two on-off valves received in the valve housing and configured for actuation by rotating the actuation pin;

an actuation apparatus for actuation of the on-off valves;

a coupling apparatus coupling the actuation apparatus to the end of the actuation pin, the coupling apparatus having an engagement feature on the end of the actuation pin opposite the operating segment; and a deflection apparatus, to convert an axial movement of the actuation pin to an axial movement of the shutoff element of the shutoff valve essentially at a right angle thereto, the deflection apparatus having a first conical element which is disposed on the actuation pin in a region of the end of the actuation pin opposite the operating segment, a second conical element which defines a center axis disposed essentially perpendicular to the actuation pin, and a third conical element having a base formed with the engagement feature and configured on the actuation pin in a region of the end of the actuation pin opposite the operating segment such that a tip of the third conical element points in a direction of the operating segment of the actuation pin and is connected to a tip of the first conical element, wherein the engagement feature permits the third conical element to move relative to the actuation apparatus along an axial direction of the actuation pin, and the engagement feature transmits rotation of the actuation pin to the actuation apparatus.

2. The gas valve unit of claim 1, constructed for setting the gas volume flow supplied to the gas burner of a gas cooker.

3. The gas valve unit of claim 1, wherein the shutoff valve has a movable shutoff element.

4. The gas valve unit of claim 1, wherein the movable shutoff element of the shutoff valve is maintained under tension to seek a closed position.

5. The gas valve unit of claim 1, wherein the movable shutoff element of the shutoff valve is maintained under tension by a spring force to seek the closed position.

6. The gas valve unit of claim 4, wherein the movable shutoff element of the shutoff valve is movable into an open position in opposition to the tension by pushing the actuation pin.

7. The gas valve unit of claim 1, wherein the second conical element has a tip which points in a direction of the first conical element.

8. The gas valve unit of claim 1, wherein the first conical element and the second conical element are configured and disposed so that an axial displacement of the actuation pin as a result of pushing on the operating segment is converted to an axial displacement of the second conical element in a direction away from the actuation pin.

9. The gas valve unit of claim 1, wherein the second conical element is actively connected to the shutoff element of the shutoff valve so that an axial movement of the second conical element in the direction away from the actuation pin is transferred to the shutoff element.

10. A gas valve unit for setting a gas volume flow supplied to a gas burner of a gas appliance, said gas valve unit comprising:

a valve housing;

an actuation pin having an operating segment which projects from the valve housing and an end located within the valve housing;

a shutoff valve received in the valve housing and configured for actuation by axially displacing the actuation pin;

at least two on-off valves received in the valve housing and configured for actuation by rotating the actuation pin;

an actuation apparatus for actuation of the on-off valves;

a coupling apparatus coupling the actuation apparatus to the end of the actuation pin, the coupling apparatus having a slot-type recess on an end face of the end of the actuation pin opposite the operating segment; and a deflection apparatus, to convert an axial movement of the actuation pin to an axial movement of the shutoff element of the shutoff valve essentially at a right angle thereto, said deflection apparatus having a first conical element which is disposed on the actuation pin in a region of the end of the actuation pin opposite the operating segment, a second conical element which defines a center axis disposed essentially perpendicular to the actuation pin, and a third conical element having a base formed with the recess and configured on the actuation pin in a region of the end of the actuation pin opposite the operating segment such that a tip of the third conical element points in a direction of the operating segment of the actuation pin and is connected to a tip of the first conical element.

11. The gas valve unit of claim 10, wherein the coupling apparatus comprises a flat carrier, which engages in the slot-type recess.

* * * * *